United States Patent [19]

Noz

[11] 4,279,730

[45] Jul. 21, 1981

[54] EQUIPMENT FOR CONTINUOUS PLATING

[76] Inventor: Francis X. Noz, Douglaslaan 5, Rosmalen, Netherlands

[21] Appl. No.: 104,293

[22] Filed: Dec. 17, 1979

[30] Foreign Application Priority Data

Dec. 15, 1978 [NL] Netherlands ..... 7812196

[51] Int. Cl.[3] ..... C25D 17/00; C25D 17/06; C25D 21/10

[52] U.S. Cl. ..... 204/206; 204/224 R; 204/237; 204/277

[58] Field of Search ..... 204/202, 206, 224 R, 204/225, 277–278, 222, 237, 15

[56] References Cited

U.S. PATENT DOCUMENTS

| | | | |
|---|---|---|---|
| 3,643,670 | 2/1972 | Sabatka et al. | 134/117 |
| 4,029,555 | 6/1977 | Tezuka et al. | 204/15 |
| 4,032,414 | 6/1977 | Helder et al. | 204/15 |
| 4,035,245 | 7/1977 | Danneels et al. | 204/224 R X |
| 4,038,169 | 7/1977 | Lovejoy et al. | 204/202 |
| 4,069,125 | 1/1978 | Marek et al. | 204/159.24 |
| 4,072,581 | 2/1978 | Allen | 204/15 |
| 4,155,815 | 5/1979 | Francis et al. | 204/224 R X |
| 4,163,704 | 8/1979 | Murata | 204/224 R X |
| 4,186,062 | 1/1980 | Eidschun | 204/224 R X |

FOREIGN PATENT DOCUMENTS

| | | |
|---|---|---|
| 2440071 | 3/1976 | Fed. Rep. of Germany . |
| 2636413 | 2/1978 | Fed. Rep. of Germany . |
| 7107171 | 11/1972 | Netherlands . |
| 1276675 | 6/1972 | United Kingdom . |

*Primary Examiner*—D. R. Valentine

*Attorney, Agent, or Firm*—Fisher, Christen & Sabol

[57] ABSTRACT

Device for selective electrodeposition of metal flat stock, on laddered or bandoliered component strips having at least one station filled with electrolyte through which the component strips are transported lengthwise. The device includes a longitudinal guide means for the component strips-the guide means is provided with a slot shaped chamber. The chamber, at its lower side is in open contact with a plating bath filled with electrolyte on a level lower than the electrolyte level in the plating bath. The guide means has apertures for introducing pressurized gas or air. The plating bath contains tubes with holes in such a position that during operation electrolyte recirculated through a transport pump can be jetted onto the portion of the metal or component strip which extends below the slot-shaped chamber of the guide means into the electrolyte.

17 Claims, 8 Drawing Figures

EQUIPMENT FOR CONTINUOUS PLATING

BACKGROUND OF THIS INVENTION

1. Field of This Invention

Figure 1:
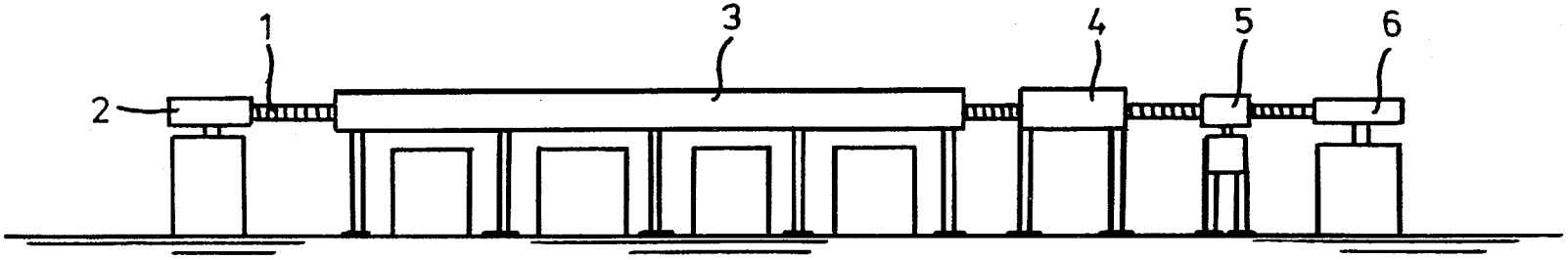

This invention concerns equipment for continuous plating of prestamped or bandoliered metal parts, which are transported lengthwise in the equipment, through tanks filled with electrolytes.

2. Prior Art

The electronic industry uses many parts which, which require for proper functioning a coating of precious metals, such as gold silver or paladium.

The high prices of precious metals will urge manufacturers to use these metals as economically as possible. This can be achieved because usually only a small area of the particular component requires a coating with precious metal for proper functioning; the remainder can be coated with a cheaper metal, such as nickel or tin, or does not require a coating at all.

Examples of parts requiring treatment as indicated are stamped frames for semiconductors, e.g., transistors, integrated circuits etc., and contact parts for the connector industry. This partial coating by electrolysis is usually called functional or selective plating.

An obvious method for selective plating is application of metal coatings as spots or strips on flat strip metal before stamping. This method offers large effective savings because flat strip can be plated accurately to a specific pattern by using nonconductive coatings or points to mask off the areas which do not require a metal coating.

Alternatively mechanical masking can be used.

Euipment for this type of selective plating has been the subject, for example, of the following Patents: U.S. Pat. Nos. 6,038,169; 4,069,125; 4,072,581 and Dutch Pat. No. 7,107,171.

These methods also have disadvantages; an obvious one is that the sides of the final product after stamping are bare and hence can corrode. The corrosion products often spread over the functional area. Further, stamping may lead to damage of the metal coating, or may cause cracks in the precious metal deposit.

To avoid these disadvantages components can also be plated after stamping, provided some form of interconnection is left between the parts to make them form a continuous strip or ribbon. Alternatively, loose parts can be assembled in an auxilliary strip to obtain the necessary bandoliered system. Such laddered or bandoliered strips of components can be plated at high speed in suitable equipment with high speed. Examples of typical machines for this type of operation can be found in U.S. Pat. Nos. 4,029,555 and 4,032,414 and in German Pat. No. 2,636,413.

The disadvantages of these machines are their limited field of application. They are typically designed for production of large numbers of the same component, and require costly tooling and involve great loss of time to be made suitable for different components.

In many cases however it is desirable to change over from production of one component to the next one of different shape without elaborate work and or costs. One method to achieve this target is to use the system of partial immersion or controlled depth plating. The laddered or bandoliered components are transported vertical through an electrolyte, whereby only that part of the component requiring a precious metal coating is immersed in the electrolyte. In many cases this can be done because the local deposit is wanted on one end of the component. This is particularly useful for contact parts and certain semiconductor frames. Change from one type of product to another is then often only a matter of regulation of solution level.

Although this type of continuous selective plating seems attractive, it has some serious disadvantages: it is slow and inaccurate. The deposition speed of a plating system depends largely on the degree of solution agitation at the surface to be plated. Strong electrolyte agitation can be otained by jetting the electrolyte onto the surface to be plated or by introducing air with the solution. An electrolyte containing 10–12 g/l of gold metal will at 45° C. deposit 1 micro-meter in 10 minutes without solution agitation. With light agitation this time can be reduced to 3 minutes, with electrolyte jetting to 10 sec.

When parts are submersed over a length of 1 to 10 mm into an electrolyte, this electrolyte cannot be strongly agitated without disturbing the solution level to such a degree that accurate immersion depth is lost. To obtain therefore an acceptable level of plating accuracy, agitation must be low and hence plating speed is slow. To for the plating speed, the length of the selective plating operation could be increased. This however leads to other problems. All stamped products show a certain degree of camber and require therefore accurate guiding to control straightness of the laddered components over a greater length. Such guiding implies a nonflexible complicated construction and is therefore a serious objection against using long plating sections for controlled depth plating.

As a solution for this problem, it has been proposed to use a transport mechanism to which component strips are connected during passage through the plating machine. Although this is a solution for some products, it is impossible to use it for such parts which require a double sided treatment, such as gold on one side and tin on the other side, which is a frequent specification.

Finally it is desirable to transport components which require selective plating with a continuous constant speed through an electrolyte to obtain maximum evenness of precious metal coatings. The use of intermittant indexing systems frequently leads to substantial differences in coating thickness from one part to the other due to difference in anode or agitation activities.

DESCRIPTION OF THIS INVENTION

This invention proposes equipment based on controlled depth plating with means to avoid the limitations described above. This can be obtained by using in the electrolyte a guide means, which is provided with a slot shaped aperture, the lower side of the slot being in open connection with the electrolyte, below the actual electrolyte level, whereas the topside of the slot is provided with openings for introducing of pressurized gas or air, the slot in the guide-means being shaped in such a way that components-strips to be plated can be transported freely lengthwise through the slot, whereby the area to be plated-extends through the lower end of the slot into the electrolyte in such an arrangement that electrolyte can be jetted on the selective area of the components during passage through the guide means, whereby the gas or air pressure in the slot shaped chamber prevents distortion of the solution level at the open lower side of the slot.

When using the guide means with a slot shaped aperture according to the invention it is possible to maintain a constant level of the electrolyte at the lower side of the slot by the introduction of pressurized air or gas into the slot shaped chamber and at the same time jet electrolyte with force onto the surface to be plated underneath the guide means without creating undesired undulations of the electrolyte level, resulting in an accurate, selective and fast deposition of the metal to be plated.

Components can be plated quickly with great accuracy, and selectivity without loss of precious metal and without contamination of the area which requires no plating.

By maintaining an airknife at the entrance and exit of the slot shaped chamber in the guide means, air or gas pressure in the chamber is easily maintained. The high speed plating requires only short length guide means which further improves accuracy as the influence of camber in the component strip is much less on a shorter length.

The invention is explained in more detail by the following a series of schemes and drawings.

FIG. 1 Schematic side view of a machine for electroplating component strips.

Figure 2:
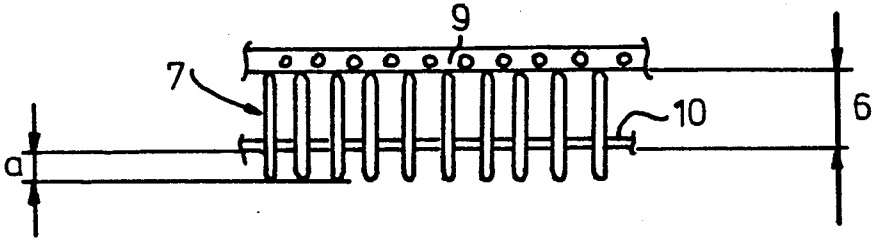

FIG. 2 Examples of typical laddered component strips.

Figure 3:
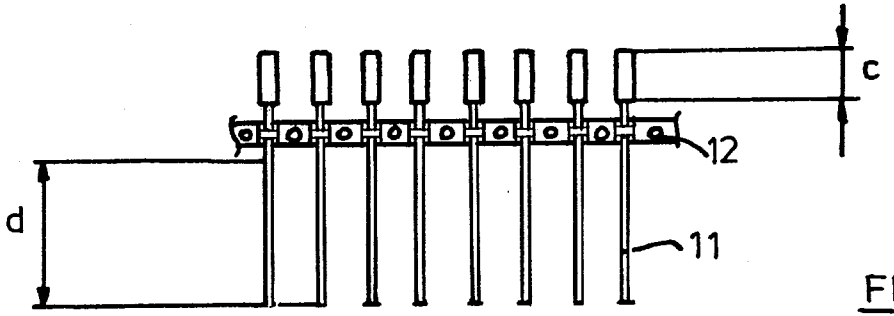

FIG. 3 Another example of bandoliered connector parts.

Figure 4:
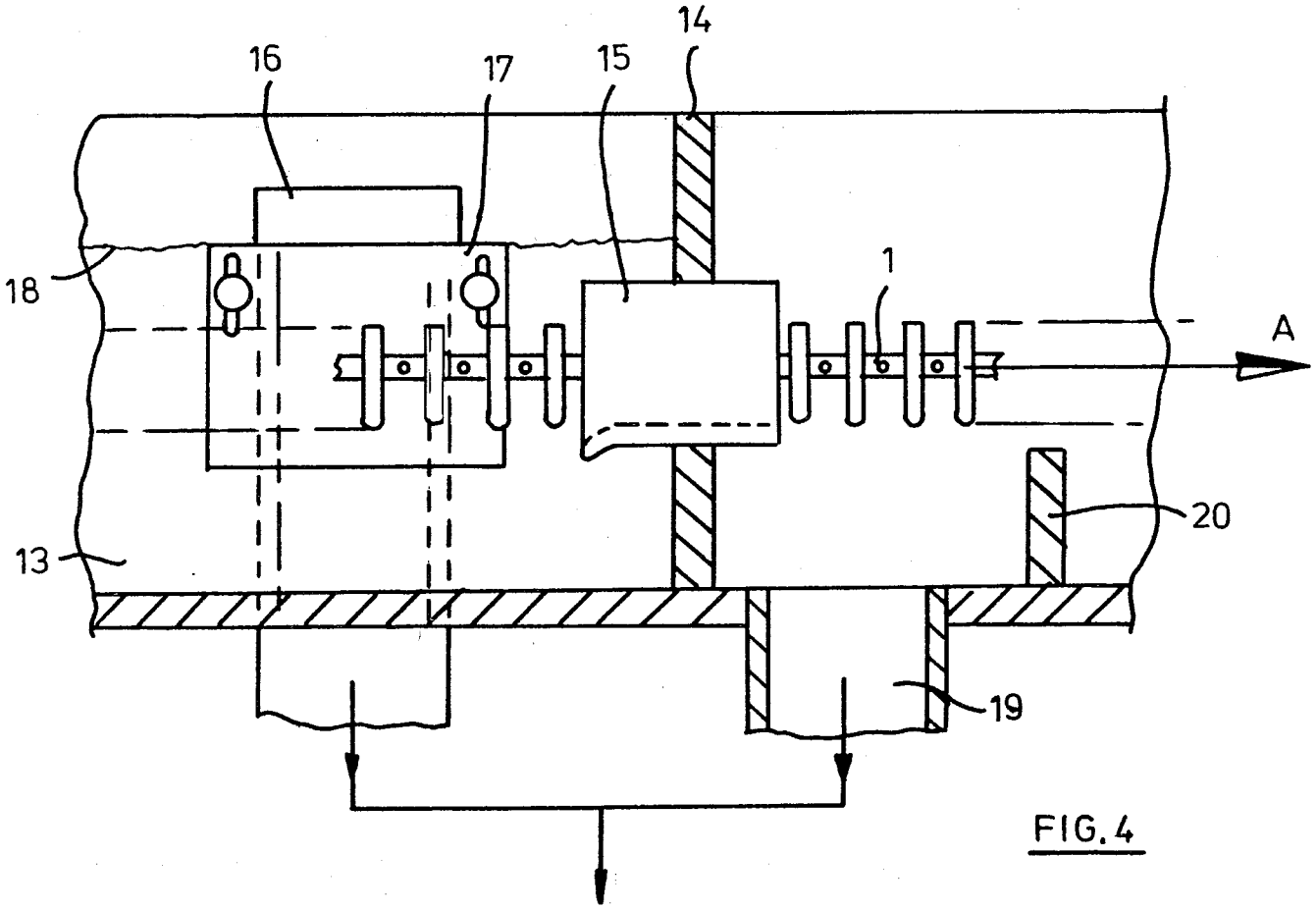

FIG. 4 Cross section of an entrance or exit side of a treatment bath of the schematic equipment of FIG. 1.

Figure 5:
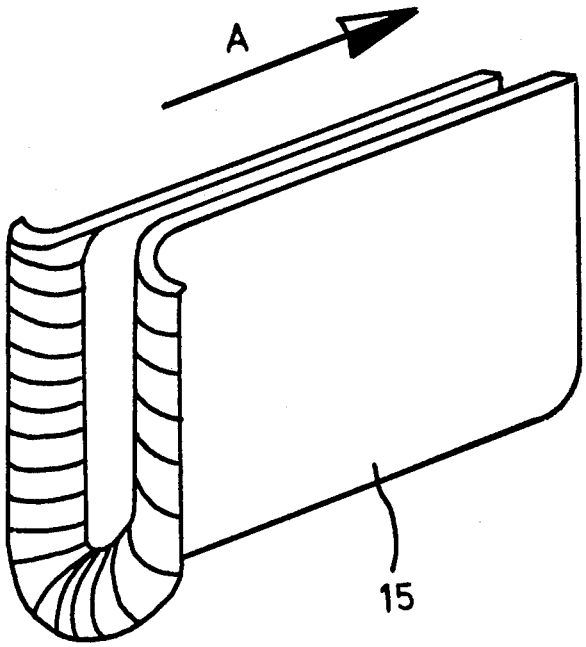

FIG. 5 A perspective view of a guide member fixed in the entrance wall of a treatment tank as shown in FIG. 4.

Figure 6:
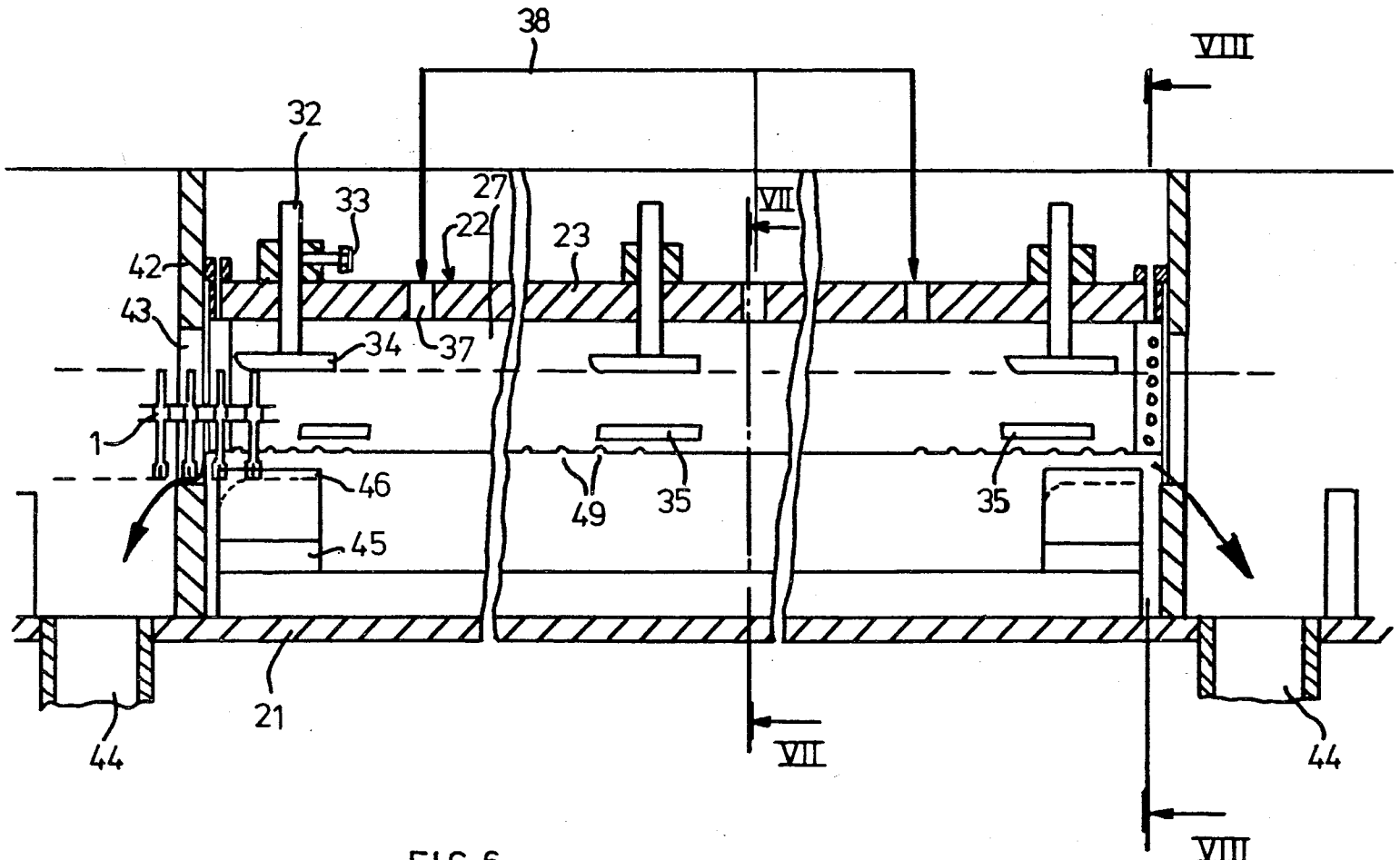

FIG. 6 A lengthwise sectional view of a guide means in a treatment bath.

Figure 7:
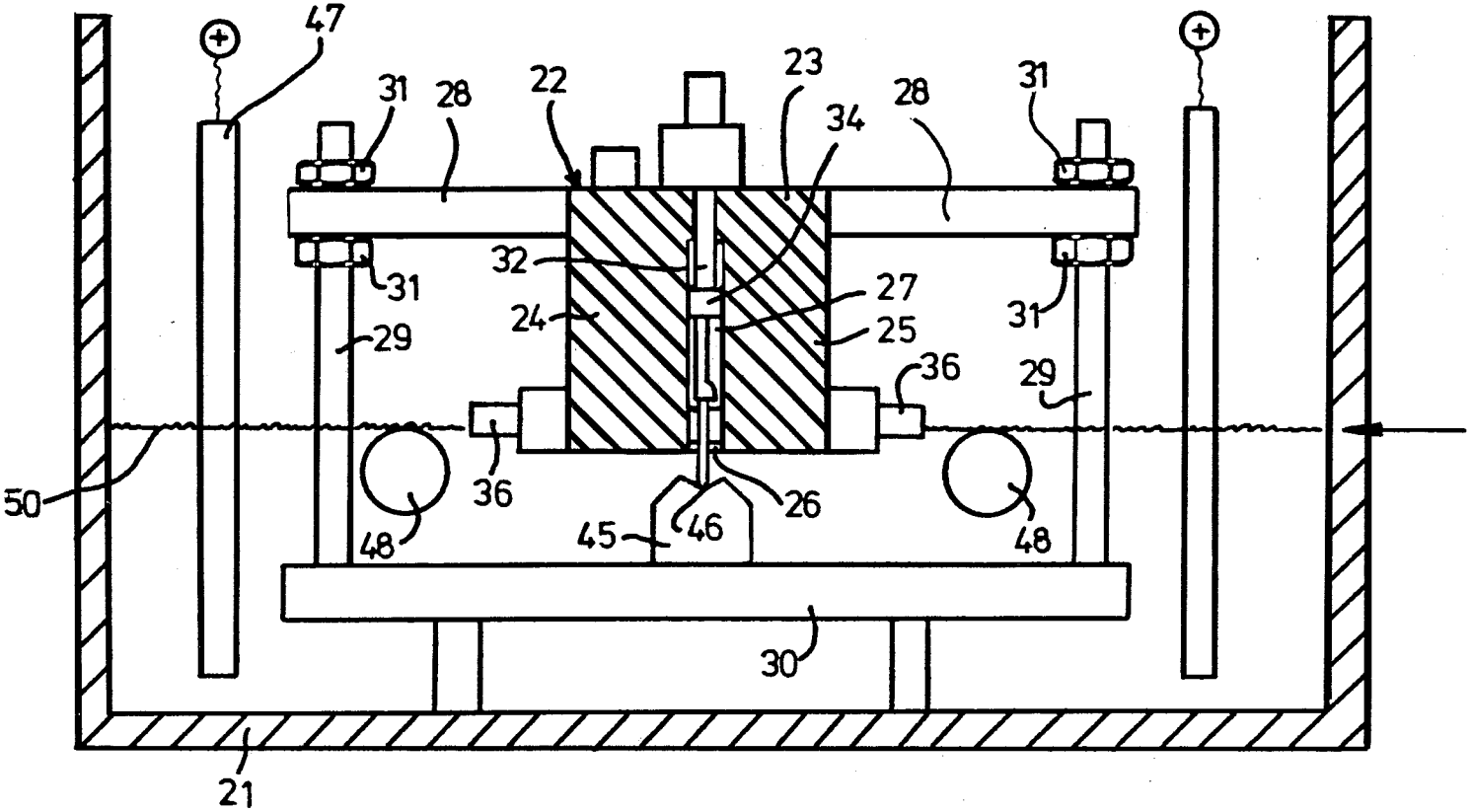

FIG. 7 Cross section along line VII—VII of the guide means of FIG. 6.

Figure 8:
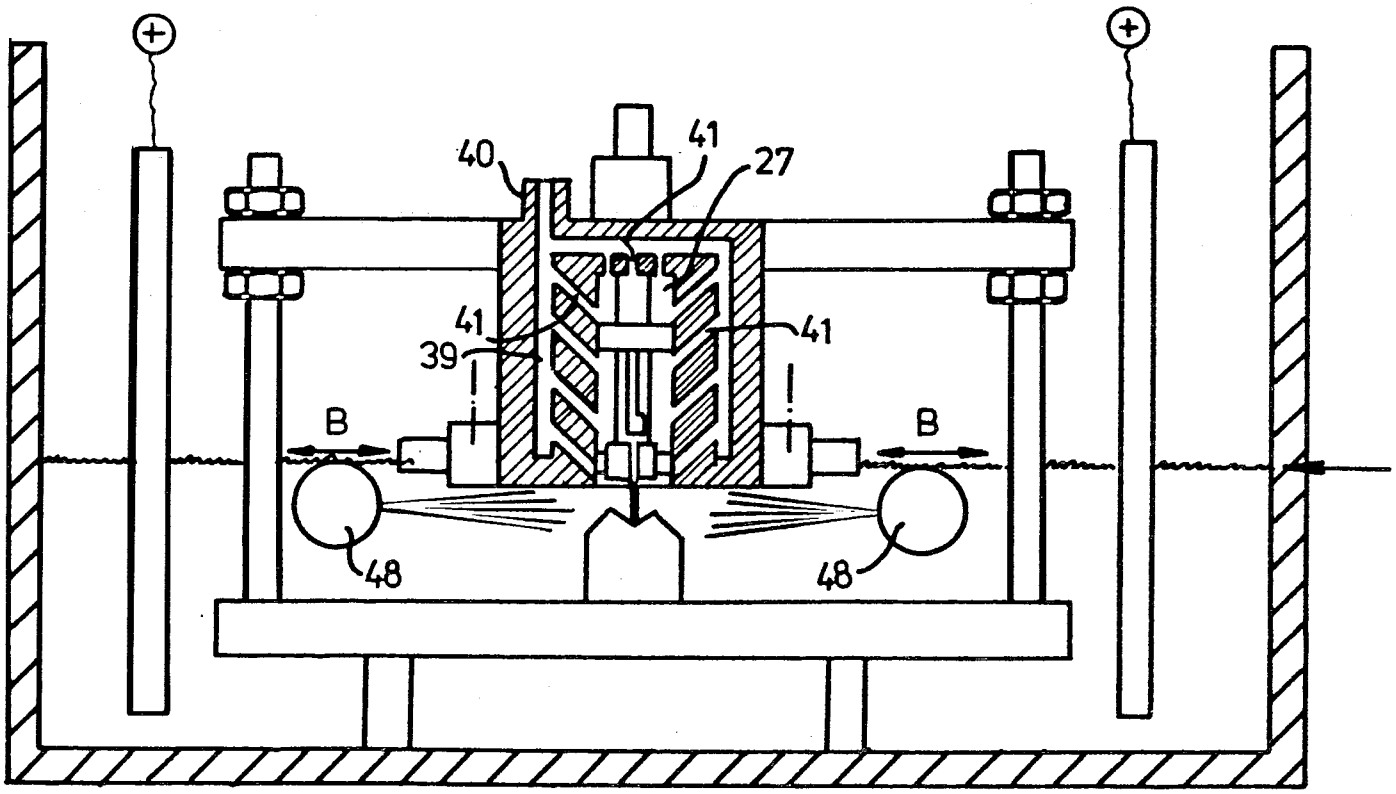

FIG. 8 Cross section along line VIII—VIII of the guide means of FIG. 6.

FIG. 1 shows a schematic view of a machine for continuous plating of component strips 1 which are fed freely from reel 2 into process sequence tanks 3 and finally through dryer 4. The transporting of the component strip can be obtained by drive system 5 which should have variable speed control to permit different dwell times in the various treatment tanks 3. At the end of the machine the completed component strip 1 can be taken-up at pick up reel 6 which should have a tension controlled drive system not indicated on the drawing.

FIG. 2 shows a typical laddered component strip containing contact pins 7 still firmly connected to carrier strip 9 and further interconnection 10. These pins require nickel plating over area a+b with exception of carrierstrip 9 which is scrapped after assembly for solderability of area 6. The contact area a of the pins, typically 4 mm long, requires a subsequent heavy coating of gold of 2 micrometer. The guide means system of this invention permits fast and accurate deposition of the required precious metal coatings and avoids unnecessary losses. By using the guide means system of this invention it is possible to obtain the heavy gold deposit of 2 micrometers in less than 30 sec. with a tolerance of 0.4 mm.

Normal controlled depth plating would require a plating time for the same deposit of 6 min. with an accuracy of a max. of 2 mm. A further example of a bandoliered component strip is shown in FIG. 3. Pin type contact part 11 is made as a loose piece and assembled in separate carrier strip 12 to permit automatic plating and assembly. These components require typically a nickel coating of 4 micrometers over area C, a subsequent hardgold coating of 3 micrometers over the same area and a 7 micrometers tin coating over area d. It is obvious that the component strip must be turned over 180 degrees lengthwise to permit this tinplating. This operation is explained below.

FIG. 4 shows a part of treatment bath 13 which it-self is part of sequence 3 and through which component strip 1 is transported in the direction of the arrow A. At the exit side of treatment bath 13 is wall 14 with an aperture containing glass guide member 15 for guiding component strip 1 with the lowest possible friction through wall 14. Glass guide member 15 is shown in perspective in FIG. 5.

As is shown in FIG. 5 the glass guide members have a U-shaped form, the entrance sides for the component strip being curved outwardly. Guide members 15 have been made of guide to obtain the lowest possible friction from component strip 1 in the guiding system, even if such strips contain protusions which would easily hook into other guide systems. Although not indicated it will be obvious that also the entrance wall of treatment bath 13 contains a glass guide member 15.

FIG. 4. shows also overflow weir 16 which can be regulated in height by sliding door 17 which determines the height of solution level 18 in treatment bath 13.

Behind wall 14, seen in the direction of arrow A, overflow return pipe 19 has been mounted the return pipe permits electrolyte which has flown from treatment bath 13 through glass guide member 15 to pass into a storage tank then to be returned by means of a transport pump into treatment bath 13. Also the overflow from weir 16 is circulated in the same manner.

Further behind wall 14, seen in the direction of arrow A, low wall 20 has been fixed to prevent the outflowing electrolyte from treatment bath 13 to flow beyond the site of wall 20.

Although electrolyte level 18 of treatment bath 13 can be adjusted it clear from the drawing that this treatment bath as drawn is designed for an all-over treatment, such as cleaning or rinsing. When only partial treatment of the component strip 1 is required the treatment bath contains a guide means according to this invention as shown in FIGS. 6–8.

FIG. 6 shows treatment bath 21 called a plating station, which has guide means 22 which is lengthwise and parallel to the transport direction of component strip, and, which encloses component strip 1 for a large part of length of the latter.

Guide means 22 in station 21 is mainly a U-shaped long chamber with top wall 23 and side walls 24 and 25 which form on the low side slot-like chamber 27 which has an open connection to the electrolyte of plating station 21 at level 26.

Guide means 22 have brackets 28 with holes in the end through which threaded rods 29 are placed. Rods 29 are fixed on support 30 on the bottom of plating station 21. By means nuts 31 on the threaded rods 29 height of guide means 22 can be adjusted.

Top wall 23 of guide means 22 contains holes through which rods 32 are placed . Rods 32 are vertically adjustable by means of screws 33 and carry guide members 34 on the interior side of guide means 22. Guide members 34 are preferably made of glass. Glass guide 34 controls the height of component strip 1 during passage through guide means 22.

Similarly adjustable rods 36 are placed in the side walls 24 and 25 of guide means 22 carrying glass guides 35 in interior side of slot shaped chamber 27 to provide and vertical guidance of component strip 1.

In top wall 23 of guide means 22 apertures 37 are present and are connected to tubes 38 through which pressurized gas or air is introduced into the interior of guide means 22.

At both ends of guide means 22 as indicated in FIG. 8, top wall 23 and side walls 24 and 25 have been provided with U-shaped channel 39 which is connected to tubular connection 40 through which pressurized gas or air is introduced in channel 39. This pressurized gas or air is guided through tubular channels to apertures 41 which blow the air across the transport direction of component strip 1 into slot-shaped chamber 27. In this way an airknife or curtain is provided at the exit and entrance of guide means 22 which permits pressure build up in chamber 27 of air or gas introduced in this chamber with the purpose of maintaining the electrolyte level at the open bottom slot side 26 of guide means 22.

At both ends of guide means 22 in plating station 21 walls 42 have been mounted with passage apertures 43. Solution overflowing through apertures 43 returns through tubes 44 to a storage tank from which it is returned to jetting system 48 by means of a transport pump.

At the interior side of walls 42 guide members 45 are placed which have centering slot 46, and determine the position of the lower side of component strip 1, during passage. More guide members 45 can be used when the length of guide means 22 or type of component requires such.

By using longer slotted guide members 45 excessive deposition of precious metal on the far ends of the components of component strip 1 can be prevented.

In FIG. 7 anodes 47 are shown in plating station 21 and jetting pipes 48 which are provided with small apertures through which the returned electrolyte is jetted on the area of the component strip 1 underneath guide means 22.

FIG. 6 further shows grooves 49 at regular distance in sidewalls 24 and 25 of guide means 22. The pressurized gas or air of slot shaped chamber 27 will escape through grooves 49 and will make possible visual control for proper level adjustment of guide means 22 possible.

On the leftside of FIG. 6, one can see a component strip one which is transported from left to right through guide means 22 in plating station 21. The upperside of the component strip is guided by glass guides 34 which are each provided with a rounded frontside to enable undisturbed passage. At both sides component strip 1 is controlled by glass guides 35. Guide members 45 prevent drag of component strip 1 below guide means 22. Also the entrance sides of guide members 45 and groove 46 are rounded as indicated in FIG. 6.

It is obvious that component strip 1 will protrude over, the well-defined and guided length of guide means 22, below the bottom side of sidewalls 24 and 25. The pressurized gas or air introduced into chamber 27 will escape through slots 49 at level 26, hence underneath level 50 of the electrolyte outside of guide means 22. The lower ends of component strip 1 will therefore pass at a well defined adjustable height through the electrolyte of plating station 21. Level 50 of the electrolyte in plating station 21 is controlled in a similar way as that of FIG. 4. Level 50 is not critical but should preferably be kept 10–20 mm higher than the lowest side of guide means 22.

The pressurized air or gas introduced into channels 39 should have a higher pressure than the gas or air introduced through apertures 37 into chamber 27, in order to form a proper air curtain which prevents pressurised air from chamber 27 from escaping through the entrance or exit side of guide means 22. Preferably the pressure of the gas or air introduced through channels 39 should be 1.2 to 5 times the pressure of the air or gas introduced through apertures 37.

Further electrolyte is jetted through tubes 48 during operation onto the lower ends of the component strip. Even high speed jetting will hardly influence the electrolyte level at slot shaped lower side 26, which is kept as narrow as possible, of guide means 22, resulting in accurate and fast deposition of metal on the selective area of component strip 1. Adjustment of jetting can be effected by axial adjustment of jet tubes 48 as indicated by arrows B in FIG. 8.

Because all guide members are preferably fabricated from glass and carry rounded edges at the entrance side of component strip 1, negligible friction is created during operation. To improve adjustability of the guide members in guide means 22 it is advantageous to manufacture guide means 22 from a transparent material such as lucite or acrylate.

Sometimes different metal deposits are required at opposite sides of component strip 1, which requires axial turning over 180 degrees of component strip 1 somewhere in sequence 3. This can be achieved easily utilizing the glass guides of this invention as shown in FIG. 5 by fixing them at an angle of 15–90 degrees in subsequent partition walls 14 (FIG. 4).

Although a certain length is required for the 180 degrees turn, no extra space is required because during the turning subsequent intermediate treatments, e.g., rinsing, activations, etc. can be accomplished.

The possibility adjusting the various guide members makes the equipment of this invention suitable for a large variety of component strips for application of different metals on both sides in one operation and due to minimum friction, also for very delicate component strips.

The arrangement of guide means 22 in plating station 21 permits use of soluble or insoluble anodes at choice. Soluble anodes are preferably for nickel and tin electrolytes.

It is obvious that the construction as described herefore enables fast and accurate selective plating of a large variety of component strips whereby the length of the plating stations can be reduced considerably compared with conventional controlled depth plating systems.

It will also be obvious that flat stock strip material can be processed in the same device to obtain a selective metal deposit at one side or both sides of the strip.

I claim:

1. In a device for selective electrodeposition of metals or flat stock or on laddered or bandoliered component strips having at least one station adapted to contain electrolyte through which the component strips can be transported lengthwise, the improvement comprising a longitudinal guide means for component strips which guide means is provided with a slot-shaped chamber, the lower end of said chamber extending down into said station to a level below the normal operating level in said station of the electrolyte contained therein during operation of said device, said guide means having apertures for introducing pressurized gas or air into said slot-shaped chamber, and tubes with holes, said tubes being located in such a position that during operation electrolyte recirculated through a transport pump can be jetted onto such a portion of the metal or component strip as extends below said slot-shaped chamber of said guide means into the electrolyte.

2. Device for selective electrodeposition as claimed in claim 1 wherein metal or component strips are guided by grooved guide members at the entrance and exit of said guide means, said grooved guide members guiding the lower portion of said metal or component strip.

3. Device for selective electrodeposition as claimed in claim 2 wherein said grooved guide members are sufficiently extended to prevent excessive metal deposition on the lower ends of the component strips.

4. Device for selective electrodeposition as claimed in claim 1 or 2 or 3 wherein said guide members are fixed in the entrance and exit walls of said station which can be filled with electrolyte or any other entrance or exit wall of any other treamtent station in the sequence required.

5. Device for selective electrodeposition as claimed in claim 4 wherein said guide members are composed of glass.

6. Device for selective electrodeposition as claimed in claim 5 wherein there are entrance and exit walls in subsequent stations carrying guide members which are at an angle from a previous one.

7. Device for selective electrodeposition as claimed in claim 6 wherein said slot shaped chamber is provided with an air or gas curtain at the entrance or exit of said guide means, the air or gas introduced in this curtain being of higher pressure than the air or gas introduced in the slot shaped chamber of the guide means.

8. Device for selective electrodeposition as claimed in claim 1 wherein the side walls of said guide means have grooved slots which are perpendicular to the transport direction of the component strip passing through said guide means.

9. Device for selective electrodeposition as claimed in claim 18 in which is included jetting means in the form of tubes parallel to said guide means, positioned at the lower side of said guide means, provided with apertures through which recirculated electrolyte is jetted towards the area directly underneath said slotted chamber in said guide means.

10. Device for selective electrodeposition as claimed in claim 9 wherein said tubular jetting means is axially adjustable.

11. In a device for selective electrodepositions of metals on laddered or bandoliered component strips having at least one station adapted to contain a electrolyte through which the component-strips are transported, the improvement comprising a longitudinal guide means for the metal or component strips, said guide means being provided with a slot shaped chamber, said slot-shaped chamber having adjustable guide members for vertical and horizontal guiding of the strips during passage through said guide means in said plating station, and said guide means having apertures for introducing pressurized gas or air into said slot-shaped chamber.

12. Device for selective electrodeposition as claimed in claim 11 wherein metal or component strips are guided by grooved guide members at the entrance and exit of said guide means, said groove guide members guiding the lower portion of said metal or component strip.

13. Device for selective electrodeposition as claimed in claim 12 wherein said grooved guide members are sufficiently extended to prevent excessive metal deposition on the lower ends of the component strips.

14. Device for selective electrodeposition as claimed in claim 11 or 12 or 13 wherein said guide members are fixed in the entrance and exit walls of said station which can be filled with electrolyte or any other entrance or exit wall of any other treatment station in the sequence required.

15. Device for selective electrodeposition as claimed in claim 31 wherein said guide members are composed of glass.

16. Device for selective electrodeposition as claimed in claim 15 wherein there are entrance and exit walls in subsequent stations carrying guide members which are at an angle from a previous one.

17. Device for selective electrodeposition as claimed in claim 14 wherein said slot shaped chamber is provided with an air or gas curtain at the entrance or exit of said guide means, the air or gas introduced in this curtain being of higher pressure than the air or gas introduced in the slot shaped chamber of the guide means.

* * * * *